United States Patent [19]

Lucas

[11] 4,448,642

[45] May 15, 1984

[54] APPARATUS FOR EVACUATING EMISSIONS OF A COKE OVEN

[75] Inventor: August Lucas, Datteln-Horneburg, Fed. Rep. of Germany

[73] Assignee: Firma Carl Still GmbH & Co. K.G., Fed. Rep. of Germany

[21] Appl. No.: 482,166

[22] Filed: Apr. 5, 1983

Related U.S. Application Data

[62] Division of Ser. No. 368,050, Apr. 14, 1982.

[30] Foreign Application Priority Data

Apr. 15, 1981 [DE] Fed. Rep. of Germany ..... 3115217

[51] Int. Cl.[3] ..... C10B 33/00; C10B 41/02

[52] U.S. Cl. ..... 202/263

[58] Field of Search ..... 201/41; 202/263, 270

[56] References Cited

U.S. PATENT DOCUMENTS

| | | | |
|---|---|---|---|
| 3,746,626 | 7/1973 | Morrison | 202/263 |
| 4,087,333 | 5/1978 | Naevestad | 202/263 |
| 4,096,040 | 6/1978 | Grosko | 202/263 |
| 4,211,612 | 7/1980 | Stog | 202/263 |
| 4,312,713 | 1/1982 | Mayer et al. | 202/263 |
| 4,334,963 | 6/1982 | Stog | 202/263 |

FOREIGN PATENT DOCUMENTS 2021863 12/1971 Fed. Rep. of Germany .

*Primary Examiner*—Bradley Garris

*Attorney, Agent, or Firm*—McGlew and Tuttle

[57] ABSTRACT

A coke oven handling apparatus, for use with a coke oven having a battery of horizontally arranged side by side coke ovens with a quenching car trackway for a coke quenching car disposed alongside the battery outwardly of a coke cake guide car which is also movable along the ovens of the battery on a guide car trackway, comprises a stationary closed gas exhaust system which has an exhaust connection adjacent the quenching car. The support structure provides a support for a hood and a trackway for the hood adjacent the quenching car trackway and a structure is supported upon and movable along the hood support and trackway structure. The hood structure includes a first hood portion of vertically deep size which is adapted to be positioned adjacent a coke cake guide car in a position to overlie coke being pushed through the guide car into the quenching car. The hook structure also includes at least one additional hood area of shallow depth which is also connectable to the exhaust connection to cover a portion of the quenching car which moves beyond the first hood portion after the initial discharge of coke has been exhausted through the first hood portion. Coke is discharged from a coke oven through the hood structure into a quenching car and the hood structure is connected to a stationary exhaust which drags away the gases and dust. As the car is advanced further additional glowing coke is passed through the first portion of the hood structure and the second portion of the hood structure is connected to the exhaust discharge so that the previously exhausted portion of the coke in the quenching car is further exhausted as it moves along.

6 Claims, 3 Drawing Figures

APPARATUS FOR EVACUATING EMISSIONS OF A COKE OVEN

This is a division of application Ser. No. 368,050 filed Apr. 14, 1982.

FIELD AND BACKGROUND OF THE INVENTION

This invention relates in general to coke ovens and in particular to a new and useful apparatus and method for evacuating emissions at the coke side of a coke oven furnace while pushing out coke cake from oven chambers.

From German Pat. No. 20 21 863, a hood is known which is suitable for carrying out a method, similar to the invention, and which, in its operating position, is connected to the opening of a coke oven chamber in a dustproof manner by means of sealing strips which are provided between a box-section coke guide and the oven and the hood.

Further known from this reference is a partition dividing the hood into a high portion corresponding to the height of the coke guide and a low portion of substantially smaller height, extending toward the quenching tower. In addition, this reference teaches that exactly predetermined proportions of the available total suction power of the exhaust system are applied to the different portions of the hood. As from the start, the once adjusted suction power is applied to all of the exhaust connections, which means that the suction is applied even in areas where no emission occurs as yet, so that a large amount of infiltrated air is taken in at those locations. This calls for an unnecessarily high total suction power requiring a larger rating and cross sections, and increasing investment as well as operating costs.

SUMMARY OF THE INVENTION

The invention is directed to a better utilization of the available suction power and thus to a reduction of operating and capital investment costs.

In accordance with the invention, glowing coke which is pushed out of each coke oven through a coke guide car is directed through a hood structure which travels along with the guide car and which is connected through a stationary exhaust connection through a flexible connection. After an initial discharge of coke is dumped into the car, the car advances and its forward end moves beneath a further hood portion which is connected to the exhaust only after the guide car advances sufficiently to effect an operation of this second exhaust system.

According to experience, the maximum dust emission may occur at the start of the pushing operation. Consequently, for the duration of this starting period, the invention provides a method in which all of the exhaust connections at which no emission is expected as yet are locked and the dust is exhausted except in the upper portion of the hood. Only after the first hot coke discharged in the quenching car is no longer aligned with the discharge area, due to the fact that the quenching car is not in position to receive further incandenscant coke, an additional exhaust connection is automatically opened.

Advantageously, the invention includes a hood structure which includes a first portion and at least one additional second portion which have separate connections to the exhaust, which may be serially put into effect. The arrangement is such that as a further additional exhaust connection is made over the car, the previous one will be again closed so that the next exhaust connection remains effective.

This is to always obtain an evacuation at the end of the quenching car while at the same time preventing a substantial reduction of the exhaustion in the discharge area. Also, by providing an evacuation at both ends, an unnecessary additional transverse or back flow of the emission gases in the exhaust tubes is prevented or reduced.

Since high emissions are also to be expected at the end of the pushing operation, as the coke from the pusher side is discharged into the quenching car, it is advantageous to provide, in accordance with the invention, that at the end of the pushing operation, the exhaust power is reduced and thereafter again increased to a maximum.

In accordance with a feature of the invention, the apparatus includes a hood structure which is adapted to travel along the support along with the coke cake guide car and be positioned on the discharge side of the coke cake guide car so that the coke cake may be discharged into the quenching car through a first hood portion which is continuously connected to a fixed exhaust system. The apparatus also includes a second hood portion which is much shallower in depth than the first hood portion and which overlies the portion of the quenching car which moves beyond the first hood portion. As the quenching car is moved it actuates first one valve to connect a first duct to the exhaust system, for the second shallow depth hood portion thereafter at least one additional valve for connecting a further exhaust duct. The valves are advantageously actuated through a linkage secured to the hood which engages with the quenching car as it moves. The quenching car advantageously contains a cam track which regulates the exhaust valve so that one or more exhaust systems can be cut in before applying exhaust vacuum over the hood.

Accordingly, it is an object of the invention to provide an improved coke evacuation system which comprises a hood which is movable along with a quenching car and a coke cake guide car in front of a battery of coke ovens which is connected to a fixed closed exhaust system through a flexible connection which permits it to be moved alongside each oven in turn and which includes at least one additional hood portion which becomes effective over the car after the coke is discharged through a first hood portion and exhausted while it is being spilled into the quenching car.

A further object of the invention is to provide a method of evacuating emissions of a coke oven which comprises directing coke through a coke cake guide car and through a hood structure which continuously exhausts the emissions of the coke and fills up a portion of the front area of the coke quenching car and further including moving the car relative to the first hood portion to move it under a second hood portion and as the coke car is advanced cutting in at least one additional exhaust connections over the coke car ahead of the portion of the car which receives the initial discharge of the coke.

A further object of the invention is to provide an emission control device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
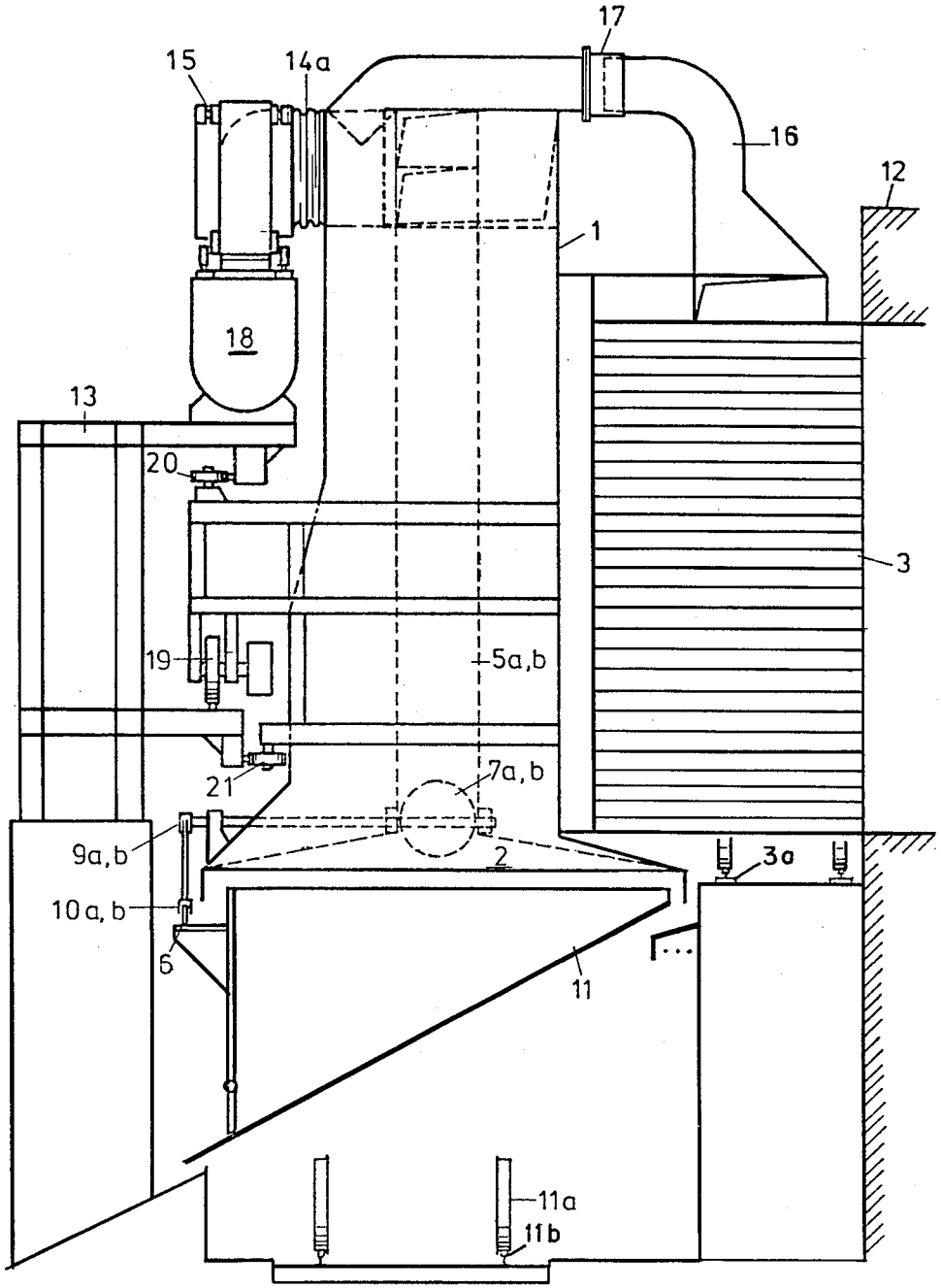
FIG. 1 is a side elevational view of a coke oven battery having emission evacuation system constructed in accordance with the invention.

Referring to the drawings in particular the invention embodied therein comprises a coke handling apparatus for use with a coke oven 12 having a battery of horizontally arranged side by side coke ovens with a quenching car trackway over which wheels 11*a* of a quenching car 11 are moved alongside the battery and outwardly of a coke cake guide car 3 which is also movable along the battery on a guide car trackway 3*a*. The handling apparatus includes a stationary closed gas exhaust system in the form of a gas duct 18 disposed on the combination of hood support and trackway 13 which is disposed adjacent the trackway 11*b* for the quenching car. The stationary closed gas exhaust system has an exhaust connection 14*a* which is connected to the movable hood structure in a manner to permit it to be moved alongside the coke cake guide car 3 adjacent each of the furnaces in a battery.

In accordance with the invention the hood structure includes a first hood portion 1 of a size to overlie a portion of the quenching car 11 across its entire width and in a position to withdraw gases and dust from the glowing coke which is pushed from the coke oven through the coke cake guide car 3 and the upper hood portion 1 and into the quenching car 11. In addition, the hood structure includes at least one second portion 2 which extends forwardly of the first hood portion 1 and is of a much shallower depth than the first hood portion. The combined length of the hood portions 1 and 2 is at least as long as the quenching car 11. The arrangement includes control means in the form of automatically shiftable control valves or dampers 7*a* and 7*b* which connect separate gas exhaust channels 5*a* and 5*b* to the fixed gas exhaust system and duct 18 as the coke quenching car 11 is moved beyond the first hood portion 1 past a partition 22 dividing the two portions to the second hood portion 2.

The figures show the inventive mechanism 7 to 10 for controlling the exhaustion of hood 1, 2 in association with a cam track provided on a quenching car 11. The total length of the exhaust hood comprising a first portion 1 having a vertically deep hood chamber and a second portion 2 of shallow depth approximately corresponds, i.e. equals, to that of quenching car 11. Prior to pushing the coke out of the coke oven chamber of a coke oven battery 12, both the coke guide car 3 and the high portion 1 of the hood must be moved into alignment with the opening 1*a* of the coke oven chamber. Then, considering FIG. 2 the left end of the quenching car is in a position below the hood first portion 1 and part of the second portion while the right end of the car is not covered completely at this time. During the pushing operation, the quenching car advances to the left and gradually occupies positions beneath the low hood portion 2, too. Upon advancing up to the first additional exhaust connection 5*a*, a roller 10*a* of linkage 9*a* comes into contact with a cam track 6 provided laterally on quenching car 11, so that as the car moves past, control valve 7*a* is gradually brought from its horizontal into its vertical position and the emission can be evacuated through tube 5*a*. Roller 10*a* may also be moved past a contact piece 6*a* or 6*b* to actuate an electrical limit switch, for example. Now, if the quenching car advances farther below the hood, the other roller 10*b* and linkage 9*b* come into contact with the cam track 6 and the other control valve 76 opens. After a certain period of time, roller 10*a* comes to move along the sloping portion of cam track 6 at the right hand side and control valve 7*a* gradually closes, partly or completely. For this purpose, springs 8*a*,8*b* are provided.

The figures also show the exhaust tubes 5*a* and 5*b* leading to the hood connection and united on their other ends in a gas collecting channel 14. Channel 14 is connected through a flexible portion 14*a* to a gas transfer carriage 15 providing a gastight connection to a stationary exhaust duct 18, even if the hood is in motion. Aside from the two exhaust connections 5*a*, 5*b* at the low portion 2 of the hood, an exhaust space 4 is provided above the high hood portion 1, to which an exhaust tube 4*a* extending over the door opening is connected. A gas exhaust 16 provided above coke guide 3 is connected to collecting channel 4 through a flange portion 17.

Figure 2:
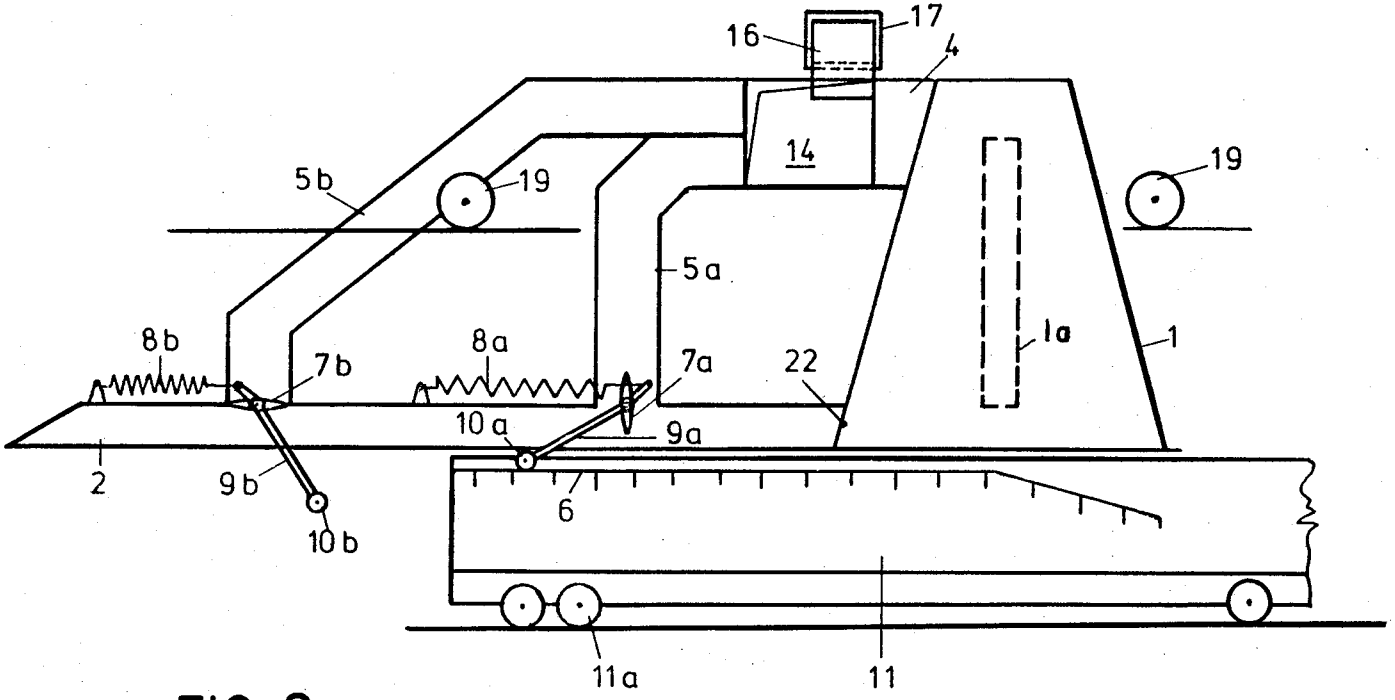
FIG. 2 is a partial front elevational view of the apparatus shown in FIG. 1.
Figure 3:
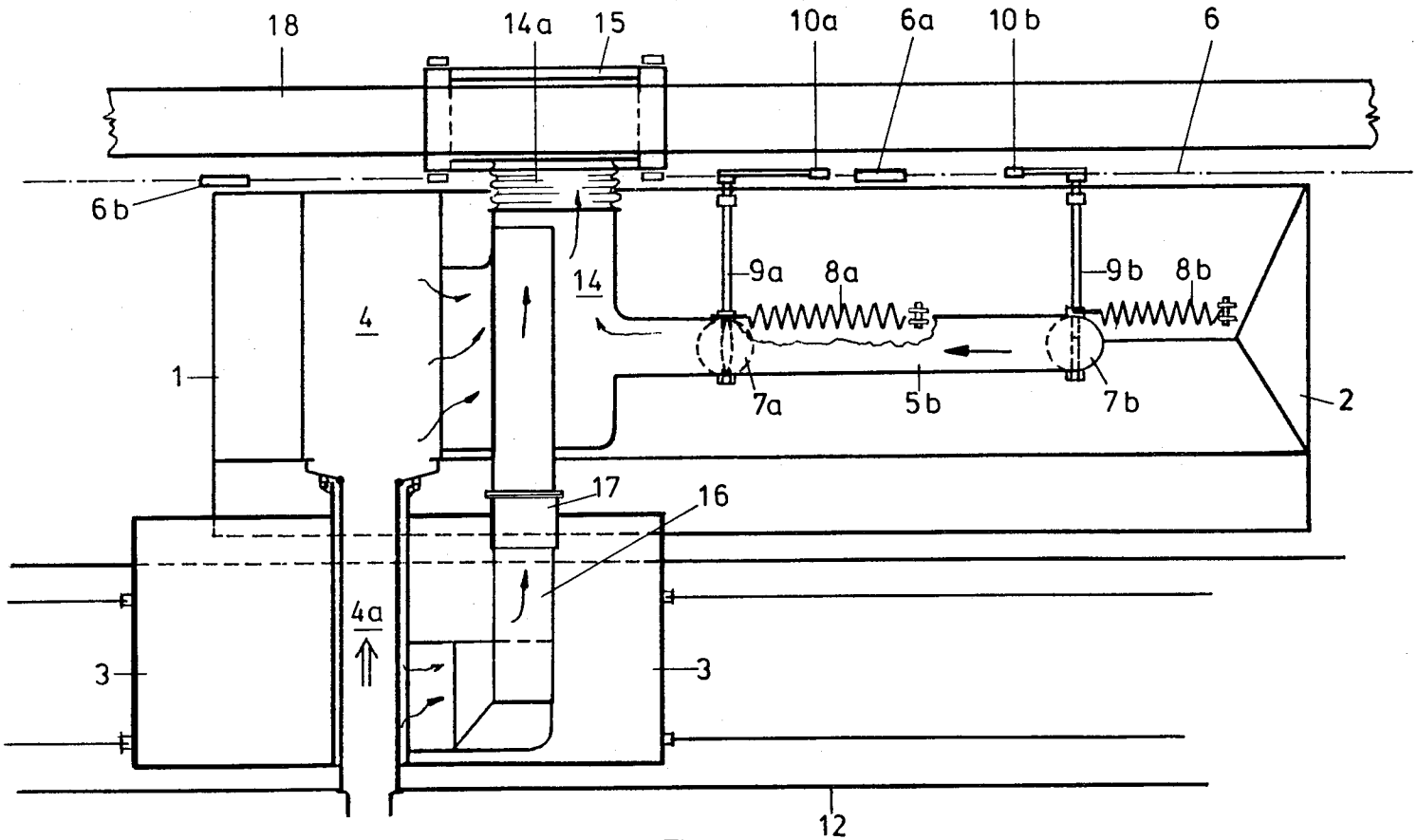
FIG. 3 is a top plan view of the apparatus shown in FIG. 1.

FIG. 1 further shows the carriage or supporting structure 15 for the hoods 1 and 2 and its relationship with the stationary exhaust duct 18. The hood structure is supported for traveling on structure 13 through rollers 19, 20,21. In FIG. 2, a partition 22 is shown which is provided between the high and low portions of the hood and extends downwardly up to the coke load in the quenching car.

While a specific embodiment of the invention has been shown and described in detail to illustrate the application of the principles of the invention, it will be understood that the invention may be embodied otherwise without departing from such principles.

What is claimed is:

1. A coke handling apparatus for use with a coke oven battery having a plurality of horizontally arranged side by side coke ovens with a quenching car trackway for a coke quenching car disposed alongside the battery outwardly of a coke cake guide car which is also movable along the ovens of the battery on a guide car trackway, comprising;

a coke quenching car for movement on the quenching car trackway;

a stationary closed exhaust system adapted to be disposed adjacent the battery and having an exhaust connection adjacent said quenching car;

means defining a hood support and trackway adapted to be adjacent the quenching car trackway;

a hood structure supported on said hood support and trackway and moveable therealong and connected to said exhaust connection and having a first hood portion of a size to overlay a portion of said quenching car across its width in a position to withdraw gases and dust from glowing coke pushed from a coke oven through the coke cake guide car and said first hood portion into said quenching car;

a second hood portion extending forwardly of said first hood portion in a position to overlay a portion of said quenching car as it is advanced with the coke which has already passed under said first hood portion;

said second hood portion having a plurality of separate exhaust channel hood connections connected to said exhaust connection with each having a control valve therein;

control means associated with said second hood portion exhaust channel hood connections to open said exhaust channel hood connections to said exhaust connection to cause additional exhaust over said quenching car, said control means including means associated with said quenching car to automatically sequentially actuate said control valves in said separate exhaust channel hood connections to selectively open and close these connections as the quenching car advances therebeneath.

2. A coke handling apparatus according to claim 1, wherein said control means includes a cam track defined on said quenching car, each of said control valves having a connecting handle engageable on said cam track and being movable by said cam track to selectively and sequentially open and close each of said control valves during relative movement between said quenching car and said second hood portion.

3. A coke handling apparatus according to claim 2, including a partition defined between said first hood portion and said second hood portion, said second hood portion being of much shallower depth than said first hood portion.

4. A coke handling apparatus according to claim 1, including a partition defined between said first hood portion and said second hood portion, said second hood portion being of much shallower depth than said first hood portion in a verticle direction above said quenching car.

5. A coke handling apparatus according to claim 4, wherein said control means includes a cam track defined on said quenching car, each of said control valves having a connecting handle engagable on said cam track and being movable by said cam track to selectively and sequentially open and close each of said control valves during relative movement between said quenching car and said second hood portion.

6. A coke handling apparatus according to claim 5, wherein said first hood portion is shorter in length with respect to the direction along the quenching car trackway than said second hood portion.

* * * * *